United States Patent [19]

French

[11] Patent Number: 4,921,456

[45] Date of Patent: May 1, 1990

[54] ELECTRICAL ASSEMBLIES INCLUDING FEMALE ELECTRICAL TERMINAL

[75] Inventor: Jay L. French, Middletown, Pa.

[73] Assignee: AMP Incorporated, Harrisburg, Pa.

[21] Appl. No.: 225,990

[22] Filed: Jul. 29, 1988

[51] Int. Cl.[5] ..... H01R 11/00

[52] U.S. Cl. ..... 439/851

[58] Field of Search ..... 439/851, 877

[56] References Cited

U.S. PATENT DOCUMENTS

| | | | |
|---|---|---|---|
| 2,600,012 | 6/1952 | Macy | 439/877 |
| 2,743,428 | 4/1956 | Martines | 439/851 |
| 2,869,103 | 1/1959 | Wells | 439/877 |
| 3,032,602 | 5/1962 | Farnell | 439/877 |
| 3,123,663 | 3/1964 | Muldoon | 439/877 |
| 3,317,887 | 5/1967 | Henschen et al. . | |
| 3,406,376 | 9/1966 | Varrin . | |
| 3,453,587 | 11/1966 | Neidecker . | |
| 3,895,853 | 7/1975 | Neidecker . | |
| 4,032,215 | 6/1977 | Jarmofsky | 439/877 |
| 4,083,622 | 4/1978 | Neidecker . | |
| 4,278,317 | 7/1981 | Gallusser et al. . | |
| 4,332,434 | 6/1982 | Neidecker et al. . | |
| 4,550,972 | 11/1985 | Romak . | |
| 4,653,826 | 3/1987 | Burgess et al. | 339/64 M |
| 4,685,761 | 8/1987 | Locati . | |
| 4,687,278 | 8/1987 | Grabbe et al. . | |
| 4,713,026 | 12/1987 | Mobley et al. . | |
| 4,715,833 | 12/1987 | Mobley et al. . | |

OTHER PUBLICATIONS

AMP Data Sheet 75-357, pp. 1,3,4.

AMP Handbook HB 5446, Revision A, p. 3.

*Primary Examiner*—Joseph H. McGlynn

*Attorney, Agent, or Firm*—Katherine A. Nelson

[57] ABSTRACT

An electrical assembly (10) includes a female electrical terminal (12) having a first sleeve portion (13) provided with four longitudinally-extending inwardly-directed convex lobes (18), each of which has a substantial line contact along the length of a male pin (11) adapted to be slidably received within the first sleeve portion (13) of the female electrical terminal (12). The four lobes (18) are arranged in the pairs of lobes, including a first lobe pair (A) and a second lobe pair (B). The first lobe pair (A) is symmetrically disposed about a first longitudinal slot (16) in the first sleeve portion (13), and the second lobe pair (B) is substantially diametrically oppositely of the first lobe pair (A) and is substantially symmetrical about a diametrical axis (19) of the first sleeve portion (13) of the female electrical connector (12) which includes the first longitudinal slot (16) therein. The second sleeve (14) has an integral portion (20, 31) providing a stop for the pin (11). In one embodiment, the pin (11) is substantially-solid and provides a heat sink for the electrical assembly.

24 Claims, 4 Drawing Sheets

21
14
32
15
17
13
16

14
6
17
5
15
13

20
17
17
14
20
6

13
20
18
16
18
14
20
18

13
18
16
A
18
19
18
B

ELECTRICAL ASSEMBLIES INCLUDING FEMALE ELECTRICAL TERMINAL

FIELD OF THE INVENTION

The present invention relates to female electrical terminals and the method of making the same, and more particularly, to a female electrical terminal having a substantially improved line contact with a cooperating male electrical terminal (such as a pin) slidably received within the female electrical terminal.

BACKGROUND OF THE INVENTION

Electrical connectors, including cooperating paired male and female electrical terminals, respectively, are well known in various electrical and electronic apparatus.

Exemplary of this prior art is the "FASTON" terminal manufactured and sold by AMP INCORPORATED of Harrisburg, Pa., U.S.A. (the assignee of the present invention). This "FASTON" terminal includes a male spade or tongue adapted to be slidably received within a female electrical electrical terminal having a pair of semi-cylindrical open barrel portions confronting the body portion thereof. A line contact is obtained, but only along the edges of the tongue. This "FASTON" terminal is intended primarily for only a limited number of make-and-break connections.

Another example of the prior art is the "MATE-N-LOCK" terminal, also manufactured and sold by AMP INCORPORATED of Harrisburg, Pa., U.S.A. (the assignee of the present invention). The "MATE-N-LOCK" female terminal has a closed barrel having only two point contacts with its cooperating male terminal. Again, while perfectly satisfactory for the purposes intended, this terminal is not intended to carry "power" currents wherein a plurality of line contacts would be a desirable feature and advantage over the available prior art.

Others in the art have resorted to cooperating terminals including respective screw-machined parts which are gold or silver plated. While perhaps satisfactory for the purposes intended, nevertheless, these terminals are quite expensive to manufacture and do not lend themselves to economical automated manufacture of electrical terminals from a coil or continuous ribbon of sheet metal using stamping and forming operations.

The prior art is further represented by the following United States Letters Patents:

| Inventor(s) | U.S. Pat. No. | Date of Issue |
|---|---|---|
| Neidecker | 3,453,587 | July 1, 1969 |
| Neidecker | 3,895,853 | July 22, 1975 |
| Neidecker | 4,083,622 | April 11, 1978 |
| Neidecker et al. | 4,332,434 | June 11, 1982 |

SUMMARY OF THE INVENTION

Accordingly, it is an object of the present invention to alleviate the disadvantages and deficiencies of the prior art by providing a female electrical terminal, especially adapted for automated economical manufacture using readily available materials, wherein the terminal is capable of conducting "power" (as well as "signal) currents, and wherein the terminal has a plurality of line contacts with its cooperating male terminal slidably received therein.

It is another object of the present invention to provide a female electrical terminal having four lines of contact, and substantially along the length of the parts male pin, thereby avoiding any necessity for parts plated with precious metals.

It is yet another object of the present invention to provide a female electrical terminal having a "transverse beam" electrical connection with its cooperating male pin terminal, as distinguished from a "longitudinal beam" electrical connection provided by a cantilevered spring finger on the female electrical terminal, the latter constituting an arrangement heretofore widely resorted to in the prior art.

It is a further object of the present invention to provide heat-radiating fins on the female electrical terminal.

It is yet still further object of the present invention to provide an "over and under" design, wherein the female electrical terminal is deliberately "under designed" from the standpoint of electrical and thermal conductivity, but wherein the male electrical terminal (preferably constituting a cylindrical pin) is deliberately "over designed", such that the male pin terminal provides a heat sink to draw heat from the assembly. Accordingly, when the mated male and female terminals are considered as an assembly and the temperature rise across the mated assembly under load matches the temperature rise of the wires to which the terminals are respectively secured, the system is said to be thermally matched.

In accordance with the teachings of the present invention, there is herein illustrated and described, a preferred embodiment of an electrical assembly including a male electrical terminal and a cooperating female electrical terminal adapted to slidably receive the male electrical terminal. The female electrical terminal includes a generally-cylindrical first sleeve portion (or barrel) having a longitudinal slot formed therein, such that the first sleeve portion may flex radially outwardly when the male electrical terminal is slidably received within the first sleeve portion of the female electrical terminal. The first sleeve has four longitudinally-extending inwardly-directed substantially convex lobes formed thereon. These four lobes are arranged in two pairs of lobes, including a first lobe pair on respective sides of the longitudinal slot in the first sleeve, and further including a second lobe pair disposed substantially diametrically opposite to the longitudinal slot. When the male electrical terminal is slidably received into the first sleeve portion of the female electrical terminal, the male electrical terminal engages the four convex lobes and makes electrical contact with the four lobes substantially along the entire length thereof.

Preferably, the male electrical terminal comprises a substantially cylindrical pin; and in a further preferred embodiment, the pin has a substantially-solid portion for improved heat-transfer properties. It is to be understood that the term "substantially solid" includes solid pins that are manufactured for example by cold forming or screw machining as well as stamped and formed pins having relatively thick walls that approximate a solid pin in cross section.

Preferably, each pair of convex lobes is substantially symmetrical about a diametrical axis of the first sleeve portion of the female electrical terminal that includes the longitudinal slot therein, and the first pair of lobes subtends an angle which is less than the corresponding angle subtended by the second pair of lobes In a preferred embodiment, the angle subtended by the first pair of lobes is approximately 34 degree, and the angle subtended by the second pair of lobes is approximately 90 degrees.

Additionally, a pair of radiating fins is formed integrally with the first sleeve portion of the female electrical terminal and extends rearwardly therefrom in the direction in which the pin is slidably inserted into the first sleeve. These heat-radiating fins include first and second radiating fins on respective sides of the longitudinal slot in the first sleeve portion of the female electrical terminal.

The female electrical terminal further includes a generally-cylindrical second sleeve portion (or barrel), extending rearwardly of the first sleeve portion of the female electrical terminal. This second sleeve is adapted to receive at least one electrical conductor therein. Preferably, this second sleeve has at least one integrally-formed portion providing a stop for the pin slidably received within the first sleeve. The stop comprises a pair of inwardly-bent diametrically-opposite tabs disposed in a plane substantially at right angles to the longitudinal axis of the second sleeve portion of the female electrical terminal. The tabs further provide a stop means for the electrical conductor member inserted into the end opposite the mating face of the female terminal.

Viewed in yet another aspect, the present invention provides an improvement to an electrical assembly having cooperating male and female terminals, respectively, wherein each male and female terminal is to be terminated to respective conductors, wherein each conductor carries at least one wire having an "O.D." (outer diameter), and wherein each conductor is provided with an insulating jacket having a a given O.D. The improvement includes a first sleeve on the female terminal for receiving the male terminal, and a second sleeve on the female terminal for receiving the wire. Both the first and second sleeves have an O.D. that is substantially equal to or less than the O.D. of the insulation jacket of its respective conductor, such that the female terminal does not interfere with (but, rather, facilitates) the miniaturization of the electronic equipment employing a plurality of terminals. Accordingly, it will be appreciated that the female terminal is deliberately "under designed" from the standpoint of electrical and thermal conductivity. The male terminal also has an O.D. that is substantially equal to or less than the O.D. of the insulation jacket of the conductor terminated thereto. The male terminal, however, has a substantially greater mass than the female terminal and is preferably made from a more conductive material. The male terminal, therefore, provides a heat sink to draw out heat from the overall assembly. Thus, and conversely to the design of the female terminal, the male terminal is deliberately "over designed". Accordingly, it will be appreciated that the assembly has an "over and under" design; and as a result, a number of important advantages are achieved: (1) excellent overall electrical and thermal conductivity is obtained, consonant with excellent mechanical properties; (2) an electrical assembly whose complete interconnection envelope is substantially equal to or less than the O.D. of the conductor jacket; (3) relatively-economical readily available strip materials may be used; and (4) relatively cost effective automated (or semi-automated) manufacture is facilitated, using existing production equipment.

These and other objects of the present invention will become apparent from a reading of the following specification, taken in conjunction with the enclosed drawings.

DETAILED DESCRIPTION OF THE PREFERRED EMBODIMENT

Figure 1:
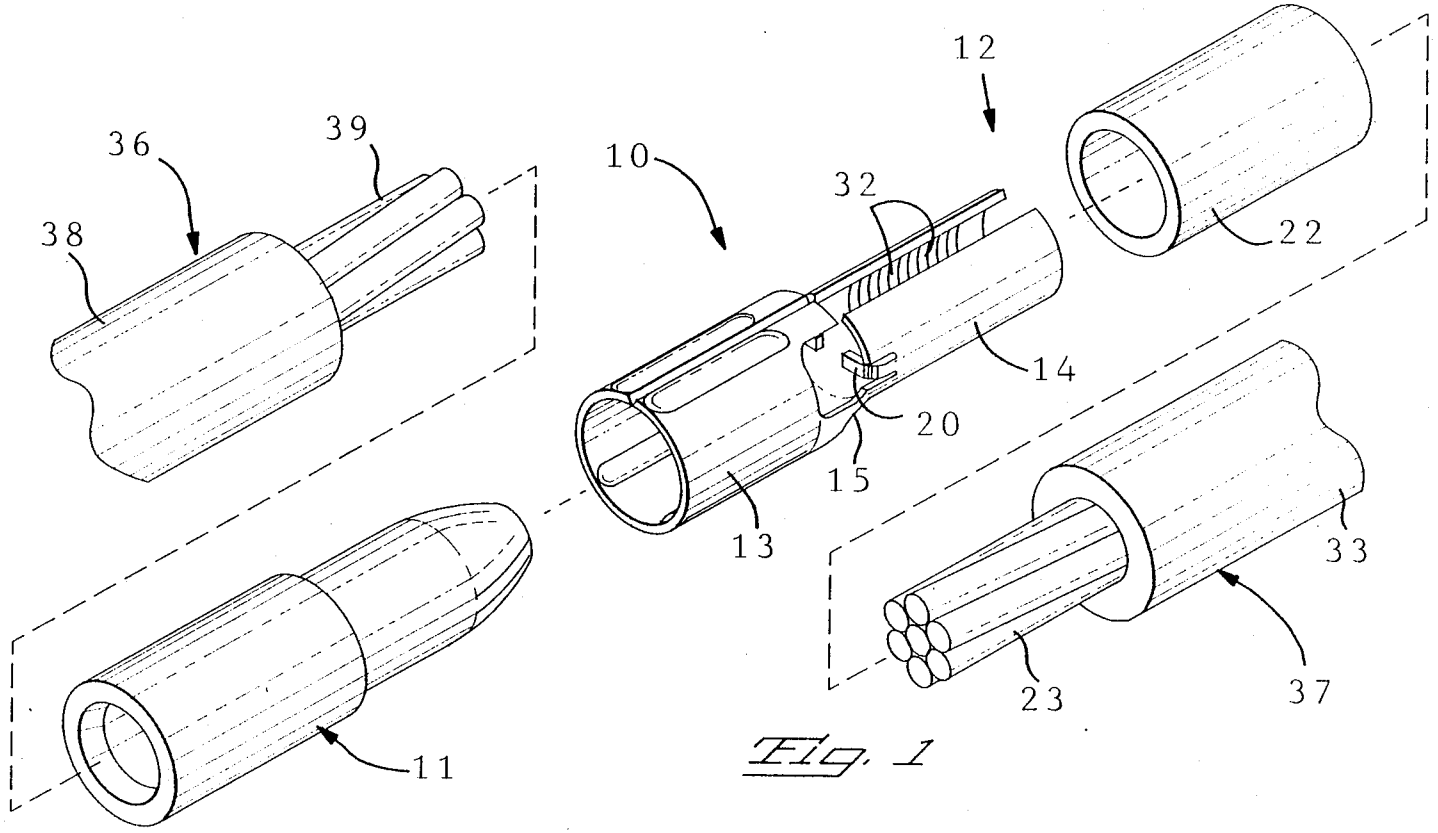
FIG. 1 is an exploded perspective view of one embodiment of the improved electrical assembly of the present invention, showing the female electrical terminal and its cooperating male electrical terminal (constituting a pin) adapted to be slidably received within the female electrical terminal.

With reference to FIG. 1, the improved electrical assembly 10 of the present invention includes a male electrical terminal (comprising a pin 11) adapted to be slidably inserted into a complementary female electrical terminal 12. Male terminal 11 is adapted to be terminated to conductor 36 and female terminal 12 is adapted to be terminated to conductor 37. Conductors 36, 37 are comprised of insulation jackets 38, 33 respectively, which surround one or more wires 39, 23 respectively.

Figures 2, 3, 4, 5, 6:
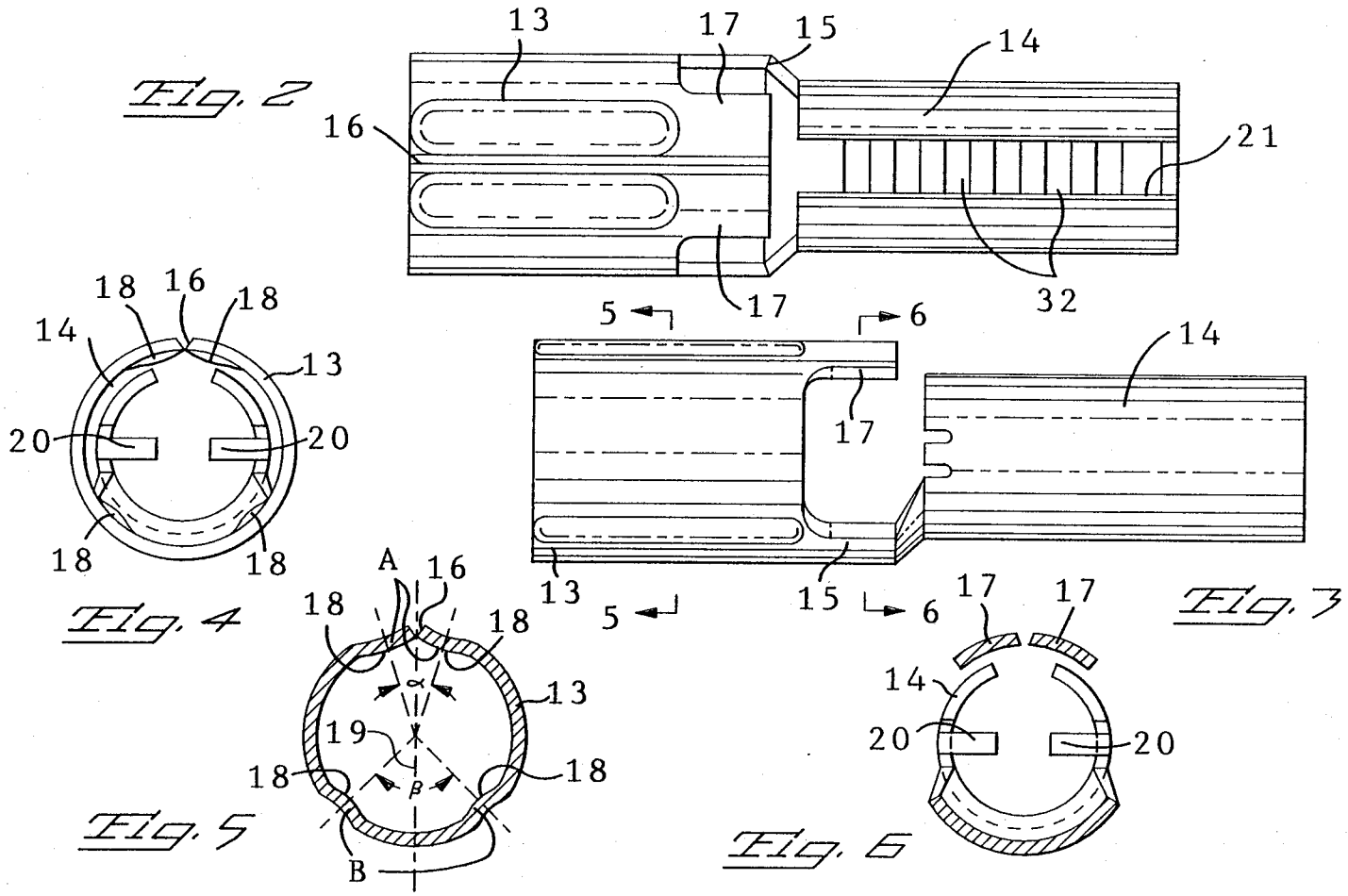
FIG. 2 is a top plan view of the female electrical terminal of FIG. 1 of the present invention, looking down on the longitudinal slot formed in the first sleeve portion of the female electrical terminal.
FIG. 3 is a side elevation view of the female electrical terminal of FIGS. 1 and 2, showing at the left-hand portion thereof, a substantially-cylindrical first sleeve portion of the female electrical terminal for receiving the male pin; further showing at the right-hand portion thereof, a substantially cylindrical second sleeve portion for receiving the electrical conductors or wires therein; and further showing an intermediate section integrally joining the first and second sleeves of the female electrical terminal.
FIG. 4 is an end view thereof, viewed in the direction in which the male pin terminal is slidably received into the female electrical terminal.
FIG. 5 is a cross-sectional view of the female electrical terminal, taken across the lines 5—5 of FIG. 3, and showing the two pairs of longitudinally-extending inwardly-directed convex lobes formed in the first sleeve portion of the female electrical terminal.
FIG. 6 is a further cross-sectional view of the female electrical terminal, taken across the lines 6—6 of FIG. 3, and showing the rearwardly-extending heat-radiating fins formed integrally with the first sleeve portion of the female electrical terminal, and further showing the forwardly-extending portion of the second sleeve portion of the female electrical terminal nested radially within the extended contours of the heat radiating fins on the first sleeve.

With reference to FIGS. 2–4, the female electrical terminal 12 includes a generally-cylindrical first sleeve portion barrel) 13 and a generally-cylindrical second sleeve (or barrel) 14 having a smaller outer diameter ("O.D.") than the first sleeve 13. A third intermediate portion 15 integrally joins the first and second portions. The first sleeve 13 has a first longitudinal slot 16 formed therein, and further has a pair of rearwardly-extending heat-radiating fins 17 formed integrally therewith (in a manner hereinafter described). The heat-radiating fins 17 include first and second radiating fins on respective sides of the first longitudinal slot 16.

As shown more clearly in FIG. 5, the first sleeve 13 has four longitudinally-extending inwardly-directed convex lobes 18 formed therein, preferably by an embossing operation. These lobes 18 are preferably arranged in two pairs, constituting a first lobe pair A disposed substantially symmetrically about the longitudinal slot 16, and a second lobe pair B disposed at respective selective locations substantially diametrically oppositely of the longitudinal slot 16 and arranged substantially symmetrically about the diametrical axis 19 (of the first sleeve 13) which includes the longitudinal slot 16. Lobes 18 extend only a slight distance inwardly from the inner surface of first sleeve 13.

Preferably, the angle $\alpha$ subtended by the two lobes 18 of the first lobe pair A is substantially less than the angle $\beta$ subtended by the other two lobes 18 in the second lobe pair B. In the preferred embodiment, angle $\alpha$ is 34 degrees and angle $\beta$ is 90 degrees. However, it will be appreciated by those skilled in the art that other angular relationships of the lobes 18, symmetrical or otherwise, may be employed consonant with the teachings of the present invention and within the scope thereof.

Figure 9:
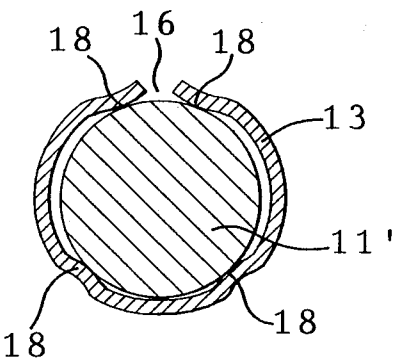
FIG. 9 is a further cross-sectional view, corresponding substantially to FIG. 8, but showing how a somewhat larger pin will cause the first sleeve portion of the female electrical terminal to flex radially outwardly, as the longitudinal slot in the first sleeve opens circumferentially by a somewhat greater degree; and further showing how the pin still makes contact with each of the four convex lobes.
Figure 8:
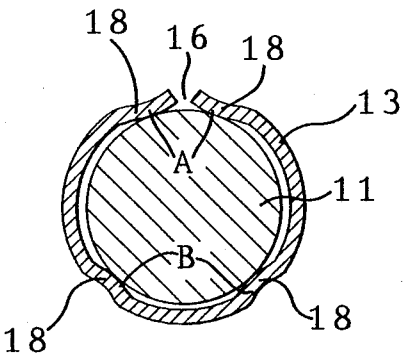
FIG. 8 is a cross-sectional view, taken along the lines 8—8 of FIG. 7, and substantially similar to the cross-sectional view of FIG. 5, but showing how the pin makes contact with each of the four convex lobes formed in the the first sleeve portion of the female electrical terminal.

Consistent with maintaining an outer diameter (O.D.) of the female terminal 12 no larger than the O.D. of the insulation jacket 33 of the conductor 37, and with reference to FIGS. 5, 8 and 9, first sleeve 13 has a generally cylindrical outermost outline free of outwardly extending projections. After formation of the lobes 18, the O.D. of the first sleeve 13 is only slightly larger than its inner diameter. Given that lobes 18 extend inwardly only a slight distance, after insertion of pin 11 and slight enlargement of sleeve 13 thereby, the resultant O.D. of first sleeve 13 is only slightly larger than its original O.D.

Figure 7:
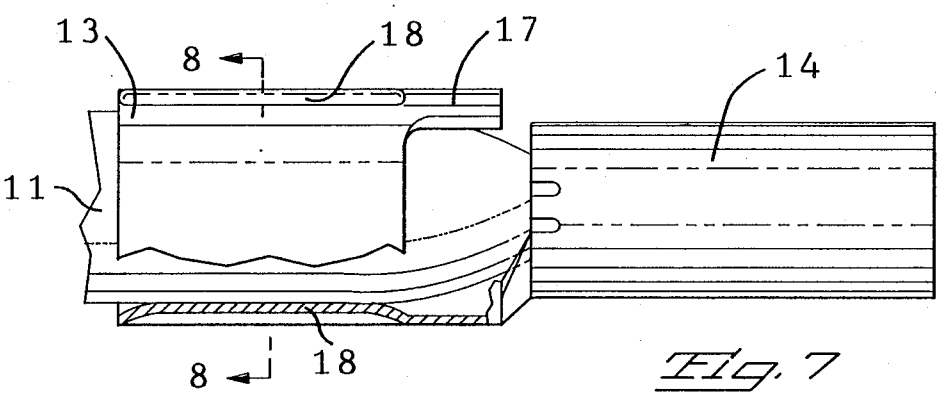
FIG. 7 is an assembled view of the male pin slidably inserted into the first sleeve portion of the female electrical terminal, the assembled view being partially in elevation and partially in longitudinal section, and being broken away to show how the forwardly-extending portion of the second sleeve of the female electrical terminal provides a stop to limit the slidable insertion of the male pin terminal into the first sleeve.

With references to FIG. 7, the second sleeve 14 of the female electrical terminal 12 has a pair of integrally-formed lanced-out inwardly-directed right-angularly bent tabs 20 disposed substantially diametrically opposite to each other to provide a stop to limit the extent to which the pin 11 may be slidably inserted into the first sleeve portion 13 of the female electrical terminal 12. These tabs further provide a stop for the wire conductor member inserted into the second sleeve portion 14. Preferable, the inner surface of second sleeve portion 14 further includes a plurality of serrations 32, as best seen in FIGS. 1 and 2. These serrations 32 are adapted to penetrate any oxide film that may be formed on bare wires 23, thereby improving the electrical termination resistance therebetween.

With reference again to FIG. 7, and with further reference to FIG. 8, the inherent utility, features and advantages of the present invention will be more readily appreciated. More particularly, when the male pin 11 is slidably inserted into the first sleeve 13 of the female electrical terminal 12, the longitudinal slot 16 in the first sleeve 13 may open slightly (circumferentially) as the first sleeve 13 flexes outwardly (radially) to accommodate the slidable reception of the pin 11; and, more importantly, the pin 11 makes a line contact with each of the four convex lobes 18 (in the first and second lobe pairs A and B, respectively) and substantially along the entire length thereof, as shown in FIG. 7.

This is an important contribution, heretofore not available in the prior art. The prior art structures and arrangements mostly had two contacts, sometimes three, but never four contacts. Moreover, there is a substantially full-line contact with the male pin 11, and not merely a point contact therewith (which is widely resorted to in the prior art). Such a point contact (or contacts) may be provided by an inwardly-directed spring finger, constituting a cantilever-beam spring contact. As further distinguished from this cantilevered beam spring contact, the present invention provides a transverse beam contact rather than a longitudinal beam contact. As a result of these important structural considerations, the present invention can readily accommodate the heavier current-carrying requirements of electrical "power" connections (besides electrical "signal" connections).

In the preferred embodiment, female terminal 12 is adapted to cooperate with a male terminal 11 that has a substantially-solid pin portion, that is a solid pin or a stamped and formed pin having relatively thick walls that approximate a solid pin in cross section. Because of the relatively large mass of the pin 11, it serves as a convenient heat "sink" to remove heat from the mated assembly.

As illustrated in FIG. 9, the first sleeve portion 13 of the female electrical terminal 12 of the present invention may accommodate a somewhat larger pin 11', causing the first sleeve 13 to flex slightly more (radially) as the longitudinal slot 16 opens somewhat wider (circumferentially) to accommodate the pin 11', the pin 11' still having a line contact with each of the four convex lobes 18.

Moreover, the male pin 11 (or 11') has a "transverse beam" line contact with the female electrical terminal 12, rather than a "longitudinal beam" contact provided by a cantilevered spring-finger contact (heretofore widely used in the prior art). This transverse beam contact, along with the substantial line contact between the pin 11 and the four convex lobes 18, provides reduced contact resistance (and hence superior electrical conductivity) consonant with improved mechanical properties for the overall assembly of the respective male and female terminals.

The second sleeve portion 14 of the female electrical terminal 12 has a second longitudinal slot 21 formed therein, which is substantially aligned with the first longitudinal slot 16 in the first sleeve 13, as shown more clearly in FIG. 2.

Figure 10:
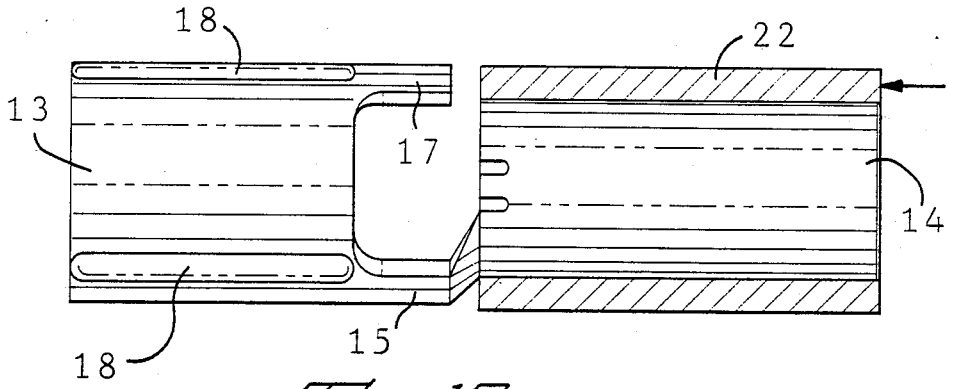
FIG. 10 corresponds to a portion of FIG. 7, but showing a copper tube lightly press-fitted over the second sleeve of the female electrical terminal.
Figure 12:
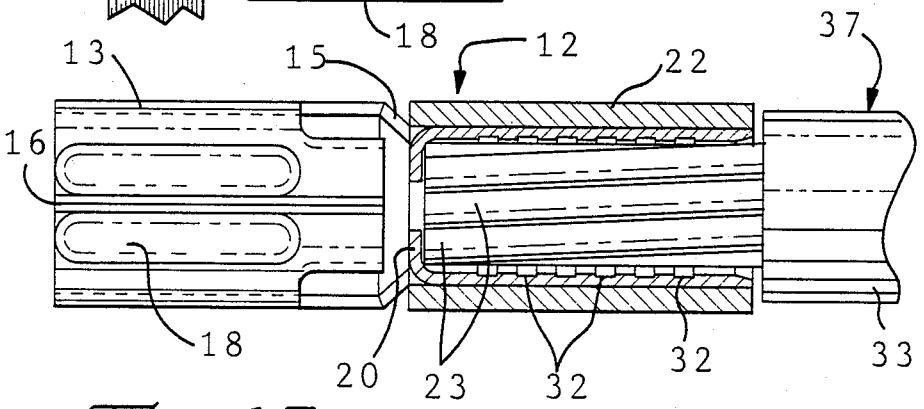
FIG. 12 is a top plan view, with certain parts broken away and sectioned, of the female electrical terminal of the present invention showing a conductor inserted into the second sleeve.

With reference to FIGS. 1, 10 and 12, a conductive tube 22 is received over the second sleeve 14. This tube 22 may be made of copper of a copper alloy (or other suitable material) and is lightly press-fitted over the second sleeve 14. One or more wires (or conductors) 23 are received within the second sleeve 14. Any number of wires or strands 23 may be used consonant with the teachings of the present invention. The second sleeve 14 is depressed or crimped (using a well-known process) to securely retain the wires 23 within the second sleeve portion 14 of the female electrical terminal 12. In a preferred embodiment, a "W" crimp is used, such that the end of the female electrical terminal 12 carrying the wires 23 resembles the letter "W".

Figure 11:
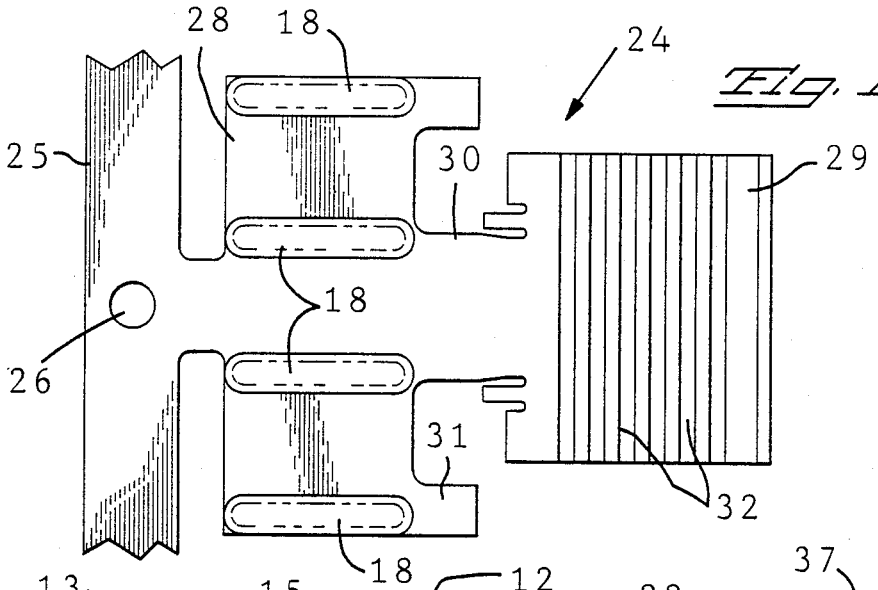
FIG. 11 is a top plan view of a stamped blank used in forming the female electrical terminal.

FIG. 11 shows a stamped blank 24 used for making terminal 12, attached to carrier strip 25. The carrier stamp 25 has a pilot hole 26 used for machine indexing purposes. As a result of the stamping and forming operations, a series of discrete spaced-apart elements is formed, each of which has a main body portion 27. This main body portion 27 has a first section 28, a second section 29, and a third intermediate section 30 integrally joining the first and second sections. A plurality (preferably four) longitudinal-extending convex lobes 18 are formed in the first section 28 by an embossing or other suitable operation.

The material chosen for making terminal 12 may be a copper alloy, and in a preferred embodiment, is designated "C63800" which is an aluminum bronze alloy. Using this material, which is readily available, the first sleeve or barrel 13 has a lesser conductivity, but conversely a higher yield "spring" function, than the second sleeve or rear barrel 14 with its more-conductive copper tube 22 crimped thereon. The copper tube 22 is made from a different alloy and has superior conductivity than the material for the blank 24. On the other hand, the copper tube 22 will be "W" crimped, as previously described and thus the copper tube 22 is not required to provide a mechanical function where resiliency of the material is an important criterion.

The terminals 12 may be severed from the carrier strip 25, if discrete terminals are desired. Alternatively, and as understood by those skilled in the art, the terminals may be retained on the carrier strip 25 (in a "batch" or a continuous strip) for subsequent automated terminations.

As best seen in FIG. 12, conductor 37 comprises wires 23 and insulation jacket 33, and it will be further appreciated that the outer diameter ("O.D.") of the tube 22 is substantially equal to or less than the corresponding O.D. of the insulation jacket 33 of conductor 37. Correspondingly, as shown in FIG. 1, the O.D. of the male terminal is substantially equal to or less than the O.D. of its respective conductor 36. The complete male and female interconnection envelope, therefore, is substantially equal to the conductor O.D., e.g. a 30A terminal having a 30 degree temperature rise will be equivalent in size to a 10 AWG style UL 1015 wire. This feature of the present invention contributes to the miniaturization of the electronic equipment (or other apparatus) employing a plurality of the female terminals 12 as, for example, in a computer backplane.

Moreover, and from the standpoint of electrical and thermal conductivity, the female terminal 12 is deliberately "under designed". Conversely, the male terminal 11 has a substantially greater mass and ability to conduct heat and electricity, and to this extent, the male terminal 11 is "over designed". Accordingly, the design of the overall assembly 10, including the male terminal 11 and the female terminal 12, may be considered an "over and under" design. Accordingly, when the mated male and female terminals are considered as an assembly and the temperature rise across the mated assembly under load matches the temperature rise of the wires to which the terminals are respectively secured, the system is said to be thermally matched.

This is another important feature and advantage of the present invention. The material chosen for the respective female terminals of the invention may be readily available and relatively economical; and even though that material may have (for example) only 10% IACS (International Annealed Copper Standard) of the conductivity of "pure" copper, which is considered the standard, nevertheless, the "over-designed" male terminal 11 in effect compensates for the lower conductivity material by drawing the heat out of the mated electrical assembly. This "heat sink" feature of the male terminal, together with the radiating fins 17 on the female terminal, allows a much more economical material to be used for the female terminal without sacrificing mechanical properties, and yet facilitating relatively cost-effective automated manufacture.

Moreover, the substantially line contact between the pin 11 and the four convex lobes 18 assures a substantially improved electrical constriction resistance between the male and female terminals, respectively. The line contact system of the present invention provides more asperities than a point contact system in separable electrical connections. The line contact system of the present invention provides a cantilevered beam that twists to conform to the shape of the cylindrical pin inserted to maximum engagement.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. An electrical assembly, comprising:

a male electrical terminal;

a cooperating female electrical terminal adapted to slidably receive the male electrical terminals and including a generally-cylindrical first sleeve portion having a longitudinal slot formed therein, such that the first sleeve may flex radially outwardly when the male electrical terminal is slidably received within the first sleeve portion of the female electrical terminal, said first sleeve being generally cylindrical and free of outwardly extending protrusions, so that the effective outer diameter thereof is only slightly larger than the inner diameter thereof;

the first sleeve portion having four longitudinally-extending inwardly-directed substantially convex lobes formed thereon at respective selected locations; and the four lobes being arranged in two pairs of lobes, including a first lobe pair on respective slides of the longitudinal slot in the first sleeve portion of the female electrical terminal, and further including a second lobe pair disposed substantially diametrically opposite to the longitudinal slot;

wherein, when the male electrical terminal is slidably received into the female electrical terminal, the male electrical terminal engages the four lobes and makes electrical contact with the four lobes substantially along the entire length thereof.

2. The assembly of claim 1 wherein each of said lobes extends inwardly of the inner surface of the sleeve only a slight distance, whereby upon mating with a male terminal and engagement by said male terminal with said lobes, said sleeve is expanded outwardly only a slight amount and the resultant outer diameter of the sleeve after mating is only slightly larger than the original generally outer diameter prior to mating.

3. The electrical assembly of claim 1, wherein each pair of lobes is substantially symmetrical about a diametrical axis of the first sleeve portion of the female electrical terminal that includes the longitudinal slot therein.

4. The electrical assembly of claim 3, wherein the first lobe pair subtends an angle which is less than the corresponding angle subtended by the second lobe pair.

5. The electrical assembly of claim 4, wherein the angle subtended by the first lobe pair is approximately 34 degrees and the angle subtended by the second lobe pair is approximately 90 degrees.

6. An electrical assembly, comprising:

a male electrical terminal comprising a substantially cylindrical pin;

a cooperating female electrical terminal adapted to slidably receive the pin and including a generally-cylindrical first sleeve portion having a longitudinal slot formed therein, such that the first sleeve may flex radially outwardly when the pin is slidably received within the first sleeve portion of the female electrical terminal, said first sleeve being generally cylindrical and free of outwardly extending protrusions, so that the effective outer diameter thereof is only slightly larger than the inner diameter thereof;

the first sleeve having four longitudinally-extending inwardly-directed substantially convex lobes formed thereon at respective selected locations;

the four lobes being arranged in two pairs of lobes, including a first lobe pair on respective sides of the longitudinal slot in the first sleeve portion of the female electrical terminal, and further including a second lobe pair disposed substantially diametrically opposite to the longitudinal slot;

each pair of lobes being substantially symmetrical about a diametrical axis of the first sleeve portion of the female electrical terminal which includes the longitudinal slot therein;

the first lobe pair subtending an angle which is substantially less than the corresponding angle subtended by the second lobe pair; and wherein, when the pin is slidably received into the female electrical terminal, the male electrical engages the four lobes and makes electrical contact with the four lobes substantially along the entire length thereof.

7. The electrical assembly of claim 6, further including a pair of radiating fins formed integrally with the first sleeve portion of the female electrical terminal and extending rearwardly therefrom in the direction in which the pin is slidably inserted into the first sleeve;

the heating radiating fins including first and second radiating fins on respective sides of the longitudinal slot in the first sleeve portion of the female connector.

8. The assembly of claim 6 wherein each of said lobes extends inwardly of the inner surface of the sleeve only a slight distance, whereby upon mating with a pin terminal and engagement by said pin terminal with said lobes, said sleeve is expanded outwardly only a slight amount and the resultant outer diameter of the sleeve after mating is only slightly larger than the original generally outer diameter prior to mating.

9. The electrical assembly of claim 6, wherein the female electrical terminal further includes a generally-cylindrical second portion extending rearwardly of the first sleeve portion of the female electrical terminal, and wherein the second sleeve portion is adapted to receive at least one electrical conductor therein.

10. The electrical assembly of claim 9, further including a conductive tube press-fitted over the second sleeve portion of the female electrical terminal.

11. An electrical assembly, comprising:

a male electrical terminal;

a cooperating female electrical terminal including a sleeve portion adapted to slidably receive the male electrical terminal, said sleeve portion being generally cylindrical and free of outwardly extending protrusions, so that the effective outer diameter thereof is only slightly larger than the inner diameter thereof, the sleeve portion having at least four longitudinally-extending inwardly-directed substantially convex lobes formed thereon at respective selected locations;

the four lobes being arranged in two pairs of lobes disposed substantially diametrically opposite to each other;

the first pair of lobes subtending an angle which is substantially less than the corresponding angle subtended by the second pair of lobes; and wherein, when the male electrical terminal is slidably received in the female electrical terminal, the male electrical terminal engages the four lobes and makes electrical contact with the four lobes substantially along the entire length thereof.

12. The assembly of claim 11 wherein each of said lobes extends inwardly of the inner surface of the sleeve only a slight distance, whereby upon mating with a male terminal and engagement by said male terminal with said lobes, said sleeve is expanded outwardly only a slight amount and the resultant outer diameter of the sleeve after mating is only slightly larger than the original general outer diameter prior to mating.

13. The electrical assembly of claim 11, wherein the sleeve portion of the female electrical terminal has a longitudinal slot formed thereon;

the first pair of lobes straddling the longitudinal slot symmetrically thereof; and wherein the second pair of lobes is further disposed substantially symmetrically about a diametrical axis of the sleeve portion which includes the longitudinal slot.

14. The electrical assembly of claim 13, wherein the angle subtended by the first pair of lobes is approximately 34 degrees; and wherein the angle subtended by the second pair of lobes is approximately 90 degrees.

15. An electrical assembly, comprising:

a male electrical terminal including an elongated substantially-solid pin portion thereof;

a cooperating female electrical terminal including a first sleeve portion adapted to slidably receive the pin, and further including a second sleeve portion adapted to receive at least one conductor therein said first sleeve portion being generally cylindrical and free of outwardly extending protrusions, so that the effective outer diameter thereof is only slightly larger than the inner diameter thereof;

the first sleeve portion having means at respective selected locations therearound to assure a plurality of line contacts between the first sleeve portion and the pin, substantially along the length thereof;

the means for retaining the conductor within the second sleeve portion of the female electrical terminal;

wherein an electrical current may flow from the pin through the female electrical terminal to the conductor with reduced contact resistance and heat losses therebetween;

the conductor being provided with an insulating jacket having an outer diameter;

wherein the second sleeve and its retaining means are "under designed" with reference to a thermally matched system, said thermally matched system being one in which the temperature rises of the mated contact terminals under load, when considered as an assembly, is matched to the temperature rise of wires attached to the respective mated terminals, the female terminal generating heat when subjected to load, said sleeve and retaining means having an outer diameter that is substantially equal to or less than the outer diameter of the insulating jacket on the conductor, thereby saving space and contributing to the miniaturization of any associated apparatus using the electrical assembly;

wherein the substantially-solid pin is "over designed" with reference to a thermally matched system in that said pin provides a heat sink for removal of heat from the assembly; and wherein relatively-economical readily-available materials may be used for the male and female terminals, respectively.

16. The electrical assembly of claim 15, wherein the means on the first sleeve to assure a plurality of line contacts between the first sleeve and the pin, comprises four longitudinally-extending inwardly-directed convex lobes formed on the first sleeve;

and wherein the four lobes are arranged in two pairs of lobes, including a first lobe pair and a second lobe pair disposed substantially diametrically opposite to each other.

17. The assembly of claim 15 wherein each of said lobes extends inwardly of the inner surface of the sleeve only a slight distance, whereby upon mating with a pin terminal and engagement by said pin terminal with said lobes, said sleeve is expanded outwardly only a slight amount and the resultant outer diameter of the sleeve after mating is only slightly larger than the original general outer diameter prior to mating.

18. An electrical assembly, comprising:

a male electrical terminal comprising a pin;

a cooperating female electrical terminal including a first sleeve portion adapted to slidably receive the pin, said first sleeve portion being generally cylindrical and free of outwardly extending protrusions, so that the effective outer diameter thereof is only slightly larger than the inner diameter thereof;

the first sleeve including a first longitudinal slot, such that the first longitudinal slot may open circumferentially, and the first sleeve flex radially outwardly, as the pin is slidably inserted into the first sleeve portion of the female electrical terminal;

means on the first sleeve portion at respective selected locations therearound for establishing a plurality of substantially line contacts between the first sleeve and the pin, and substantially along the length thereof;

the female electrical terminal further having a second sleeve portion integrally joined to the first sleeve portion and extending rearwardly therefrom;

the second sleeve having a second longitudinal slot formed therein, substantially aligned axially with the first longitudinal slot on the first sleeve, and having a substantially greater circumferential opening than the circumferentially opening of the first longitudinal slot in the first sleeve;

at least one conductor received within the second sleeve portion of the female electrical terminal;

a tube fitted over the second sleeve and crimped thereon, thereby securely retaining the conductor within the second sleeve of the female electrical terminal; and the second sleeve having at least one inwardly-bent tab formed thereon, thereby providing a step for limiting the insertion of the pin into the female electrical terminal.

19. The assembly of claim 18 wherein each of said lobes extends inwardly of the inner surface of the sleeve only a slight distance, whereby upon mating with a pin terminal and engagement by said pin terminal with said lobes, said sleeve is expanded outwardly only a slight amount and the resultant outer diameter of the sleeve after mating is only slightly larger than the original general outer diameter prior to mating.

20. In an electrical assembly having cooperating male and female terminals, respectively, wherein the male and female terminals are to be terminated to respective conductors, each conductor comprised of at least one wire having an O.D. and an insulation jacket having a given O.D., the improvement which comprises:

a first sleeve on the female terminal for receiving a male terminal, said first sleeve being generally cylindrical and free of outwardly extending protrusions, so that the effective outer diameter thereof is only slightly larger than the inner diameter thereof;

a second sleeve on the female terminal for receiving the at least one wire, the second sleeve having an O.D. which is not larger than the O.D. of the insulation jacket on the conductor to which it is to be terminated, such that the female terminal is deliberately "under designed" from the standpoint of electrical and thermal conductivity with reference to a thermally matched system, said thermally matched system being one in which the temperature rise of the mated contact terminal under load, when considered as an assembly, is matched to the temperature rise of wires attached to the respective mated terminals, said female terminal generating heat when subjected to load; and the male terminal has an O.D. that is substantially equal to or smaller than the O.D. of the insulation jacket of its respective conductor, and has a substantially greater mass than the female terminal such that the male terminal is deliberately "over designed" from the standpoint of electrical and thermal conductivity, with reference to a thermally matched system, and such that the male terminal provides a heat sink to draw out heat from the assembly; whereby the electrical assembly has an interconnection envelope that is substantially equal to or less than the O.D. of the conductor jacket and wherein the assembly has an "over and under" design, thereby facilitating the use of readily available relatively-economical materials, and thereby facilitating relatively costs effective automated manufacture.

21. The improvement of claim 20, wherein the first sleeve has four longitudinally-extending inwardly-oriented convex lobes, each of which has a line of contact with the male terminal substantially along the length thereof.

22. The improvement of claim 21, wherein the first sleeve has a longitudinal slot formed therein, and wherein the four convex lobes are arranged in two pairs of lobes, including a first lobe pair straddling the longitudinal slot, and further including a second lobe pair arranged substantially diametrically opposite to the first lobe pair.

23. The improvement of claim 22, wherein each lobe pair is substantially symmetrical about a diametrical axis of the first sleeve which includes the longitudinal slot therein.

24. The improvement of claim 23, wherein the first lobe pair subtends an angle which is substantially less than the angle subtended by the second lobe pair.

* * * * *

UNITED STATES PATENT OFFICE

CERTIFICATE OF CORRECTION

Patent No. 4,921,456 Dated May 1, 1990

Inventor(s) Jay L. French and James Wise

It is certified that error appears in the above-identified patent and that said Letters Patent is hereby corrected as shown below:

Claim 1, Column 8, Line 64 - the word "slides" should be --sides--.

Claim 7, Column 9, Line 67 - the word "heating" should be --heat--.

Claim 15, Column 11, Line 26 - the word "rises" should be --rise--.

Claim 18, Column 12, Line 27 - the word "step" should be --stop--.

Claim 20, Column 12, Line 58 - the word "terminal" should be --terminals--.

UNITED STATES PATENT AND TRADEMARK OFFICE

CERTIFICATE OF CORRECTION

PATENT NO. : 4,921,456

DATED : May 1, 1990

INVENTOR(S) : Jay L. French and James Wise

It is certified that error appears in the above-identified patent and that said Letters Patent is hereby corrected as shown below:

On the title page:

Item [75] Inventors: add --James H. Wise-- as a co-inventor.

Signed and Sealed this

Eighteenth Day of February, 1992

*Attest:*

HARRY F. MANBECK, JR.

*Attesting Officer*

*Commissioner of Patents and Trademarks*